US006227097B1

(12) United States Patent
Brianne et al.

(10) Patent No.: US 6,227,097 B1
(45) Date of Patent: May 8, 2001

(54) DEVICE TO REGULATE THE COUNTER-RECOIL RATE ARTILLERY CANNON ACCORDING TO THE TEMPERATURE

(75) Inventors: Joël Brianne, Vasselay; Alain Charton, Crosses, both of (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/444,702

(22) Filed: Nov. 24, 1999

(30) Foreign Application Priority Data

Nov. 25, 1998 (FR) ..... 98 14929

(51) Int. Cl.[7] ..... F41A 25/02
(52) U.S. Cl. ..... 89/43.01; 89/198
(58) Field of Search ..... 89/43.01, 198, 89/177, 42.01

(56) References Cited

U.S. PATENT DOCUMENTS

H217 2/1987 Jorczak ..... 89/43.01
5,168,120 * 12/1992 Rossel ..... 89/43.01
5,663,521 * 9/1997 Mandereau et al. ..... 89/43.01

FOREIGN PATENT DOCUMENTS 1505915 12/1967 (FR) .

* cited by examiner

*Primary Examiner*—J. Woodrow Eldred
(74) *Attorney, Agent, or Firm*—Oliff & Berridge, PLC

(57) ABSTRACT

The technical scope of the invention is that of devices to regulate the counter-recoil rate of an artillery cannon according to the temperature.

The regulation device according to the invention comprises a buffer co-operating with a ring, so as to ensure the gradual braking of the cannon at the end of the counter-recoil operation by rolling the brake oil through a leakage section located between the buffer and the ring. It is characterized in that it incorporates at least one modulation device comprising a heat-sensitive element made in a shape-memory alloy, such element ensuring, by its distortion, an increase in the leakage section when the temperature drops below a given threshold.

Application to recoil mechanisms of artillery cannons.

11 Claims, 9 Drawing Sheets

DEVICE TO REGULATE THE COUNTER-RECOIL RATE ARTILLERY CANNON ACCORDING TO THE TEMPERATURE

BACKGROUND OF THE INVENTION

The technical scope of the present invention is that of recoil mechanisms for artillery cannons.

In a known manner, an artillery cannon comprises:

- a recoil mass, essentially formed by a barrel-breech assembly,
- a recoil mechanism, generally hydraulic, placed between the recoil mass and a cannon top carriage.

The recoil mechanism is formed of a recoil brake and a recuperator. The recoil brake is intended to brake and limit the recoil of the recoil mass after firing. The role of the recuperator is to stock part of the recoil energy and thereafter to return it to the recoil mass to perform the counter-recoil, in preparation for further firing.

During the counter-recoil, the recoil mass is gradually braked at the end of its course, so as to avoid jolting the top carriage. This braking is generally ensured by a buffer that penetrates inside a ring rolling the oil located between the two parts. This braking device operating at the end of the counter-recoil is generally an integral part of the recoil brake.

According to the temperature, the brake oil of the recoil brake is of variable viscosity. At low temperatures, its viscosity is increased, causing the braking to slow down at the end of the counter-recoil, and thus increasing counter-recoil time. This causes the firing rates of the artillery cannon to be reduced, which is extremely disadvantageous for the weapon system.

SUMMARY OF THE INVENTION

The aim of the invention is to propose a device to regulate the counter-recoil of an artillery cannon, according to the temperature, thus enabling the afore-mentioned disadvantages to be overcome.

Thus, the subject of the invention is a device to regulate the counter-recoil rate for an artillery cannon according to the temperature, comprising a buffer co-operating with a ring, so as to ensure the gradual braking of the cannon at the end of the counter-recoil operation by rolling the brake oil through a leakage section located between the buffer and the ring, wherein said device incorporates at least one modulation device comprising a heat-sensitive element made in a shape-memory alloy, such element ensuring, by its distortion, an increase in the leakage section when the temperature drops below a given threshold.

The heat-sensitive element can, advantageously, be constituted by the ring and/or the buffer.

According to another embodiment, the heat-sensitive element can be integral with the buffer.

According to a first variant embodiment, the buffer can incorporate an additional passage for the oil whose section is modified by the modulation device displaced by the action of the heat-sensitive device. The additional oil passage can be constituted by at least one blind axial channel opening out to the fore of the buffer and by a blind radial channel made somewhere to the rear of the buffer, the two channels being inter-connected. The modulation device can comprise a tube placed inside the axial channel of the buffer, such tube being able to block the radial channel under the action of the heat-sensitive element when the temperature has reached the given threshold, such tube being displaced axially in one direction by the action of the heat-sensitive element and in the other by the action of a spring.

According to a second embodiment, the buffer can incorporate a second axial channel opening out at the end of the radial channel so as to provide the additional oil passage and the modulation device can comprise an axial rod placed inside the first axial channel, such rod being able to block the radial channel under the action of the heat-sensitive element when the temperature exceeds the given threshold. The rod can incorporate a groove for the passage of the oil and can be displaced axially in one direction by the action of the heat-sensitive element and in the other by the action of a spring so as to bring the groove opposite the radial channel of the buffer.

According to another embodiment, the rod can incorporate a radial opening for the passage of the oil located level with the radial channel of the buffer and it can be displaced angularly by the heat-sensitive element. The modulation device can comprise a flap able to block the front end of the axial channel of the buffer, such flap being displaced angularly by the heat-sensitive element.

BRIEF DESCRIPTION OF THE DRAWINGS

The invention will be better understood after reading the following description of the different embodiments, such description being made with reference to the appended drawings, in which.

DETAILED DESCRIPTION OF PREFERRED EMBODIMENTS

Figure 1:
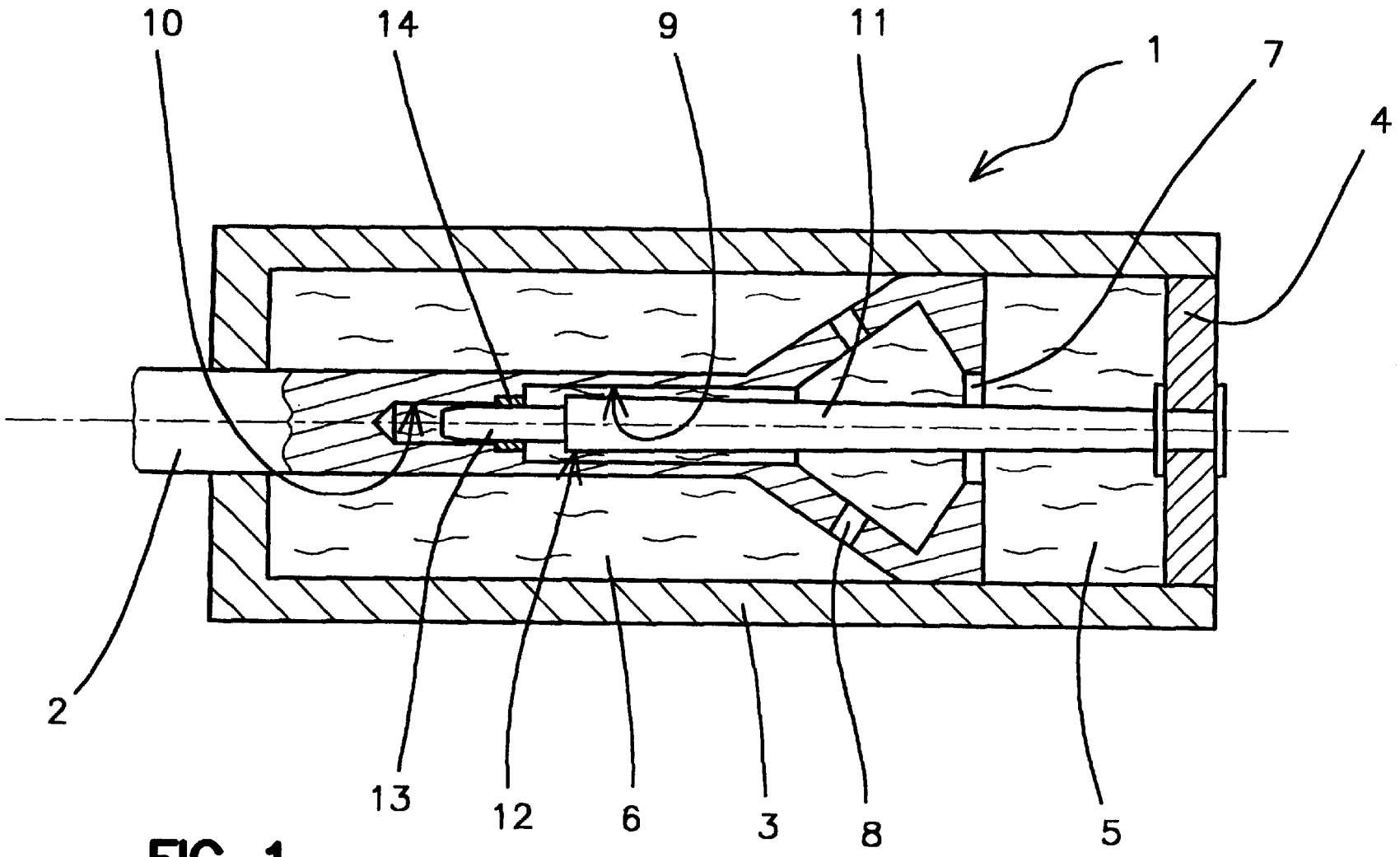
FIG. 1 is a section view of a recoil brake accommodating a braking device for the counter-recoil, in the starting position.

With reference to FIG. 1, a recoil brake 1 according to prior art, incorporates a piston 2 sliding inside a cylinder 3. Said cylinder incorporates a cover 4 mounted integral with it, and contains a fluid, generally oil.

The piston 2 thus defines, inside the cylinder 3, a first ring-shaped chamber 5 and a second chamber 6. It incorporates openings 7 and 8, a first axial cylindrical bore 9, followed by a second axial cylindrical bore 10, of a smaller diameter. The bore 10 receives a ring 14 integral with the piston 2, whose purpose will be explained later.

The cylinder 3 can be integral with an immobile top carriage of the artillery materiel (not shown), and the piston 2 can be integral with the recoil mass (not shown), or vice-versa, according to the type of artillery materiel.

A conical counter-rod 11 is mounted integral with the cover 4 of the cylinder 3. The largest diameter of the counter-rod, located towards its end 12, is of a dimension less than that of the inner bore 9 of the piston 2, such that the oil can freely circulate between the piston 2 and the counter-rod 11, the smallest diameter being located level with the cover 4.

A buffer 13 is mounted integral, for example by threading, to the end 12 of the counter-rod 11.

The oil contained in the cylinder 3 is intended, first of all, to provide braking for the relative motion of the piston/cylinder during the recoil of the recoil mass. The braking intensity depends on the geometry of the means of communication between the two chambers 5 and 6. In this case, the means of communication are constituted by the combination of openings 7 and 8 of constant geometry and the counter-rod 11 of variable diameter over its length. During the relative piston/cylinder motion, the counter-rod 11 reduces the section of the opening 7 of the piston 2, thereby varying the section for the oil passage between the two chambers and thus the braking intensity.

Secondly, the oil is intended to ensure the braking of the recoil mass at the end of the counter-recoil operation. To do this, the buffer 13 penetrates inside the ring 14 of the piston 2 rolling the oil through a leakage section located between the two parts. In a known manner, so as to ensure gradual braking during the counter-recoil, the buffer can be made according to at least two concepts. The first concept consists in making the outer profile of the buffer slightly conical in shape, the base of the cone being located on the side of the counter-rod 11. The second concept consists in making one or several longitudinal grooves on the outer diameter of the buffer. This groove, or grooves, has a depth that gradually reduces as it approaches the counter-rod 11.

Figure 2:
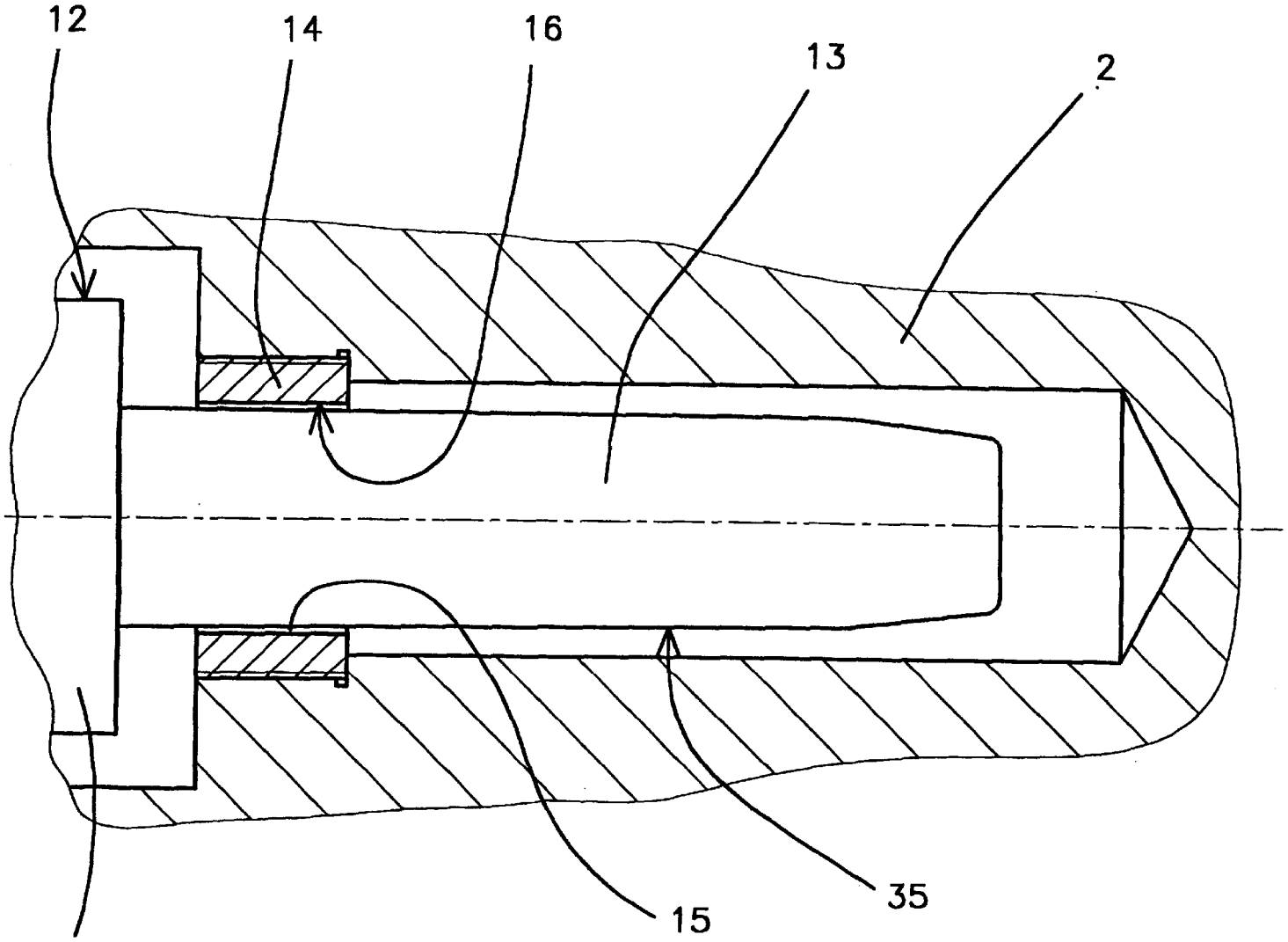
FIG. 2 is a section view of a device to regulate the counter-recoil rate of a cannon, according to a first embodiment.

FIG. 2 shows a first embodiment of a device to regulate the counter-recoil rate of a cannon according to the invention. It is a partial view of a recoil brake level with the buffer 13, of the type described previously in FIG. 1.

In a known manner, a slight play or leakage section 15 remains between the outer diameter 35 of the buffer 13 and the inner diameter 16 of the ring 14. The outer profile of the buffer being, for example, slightly conical in shape, according to a known concept in prior art and as explained earlier in the text, the leakage section 15 varies according to the relative position of the buffer 13 and the ring 14. Thus, during the counter-recoil of the recoil mass, the oil is gradually rolled in the leakage section 15, ensuring the gradual braking of the recoil mass.

According to the temperature, the recoil brake oil can have variable viscosity that increases when the temperature drops.

In this embodiment, the buffer is a heat-sensitive element made of a shape-memory alloy.

So-called shape-memory alloys allows the manufacture of mechanical parts that, after having been subjected to strain, can recover their starting shape as soon as the temperature has reached a certain level. This effect occurs only at a specific temperature that is selected when the mechanical element is being defined.

The heat-sensitive element, subject of the invention, is made of an alloy having two reversible shape-memory states, that is it is able to ensure two different positions. Thus, in this embodiment, the diameter of the buffer will be greater at low temperatures than at high temperatures, thereby enabling the leakage section to be increased when there is high oil viscosity.

The heat-sensitive element has firstly been subjected to a so-called forming process enabling it to occupy, according to the temperature at which it is subjected, both aforementioned memorized shape positions or states. The forming process relies on the passage of the alloy from its austenitic-type crystallographic phase to its martensitic-type phase.

The properties of these alloys and their forming process are well known to the expert and therefore will not be described here in any further detail.

The threshold temperature that corresponds to the phase transition temperature of the alloy will easily be defined by the expert, depending on the conditions of use of the artillery materiel, on the type of oil used and the type of alloy.

The buffer made of shape-memory ally can, for example, be constituted by an alloy of the nickel-titanium, nickel-titanium-iron, nickel-aluminum, copper-zinc-aluminum or copper-aluminum-nickel composite groups.

When the oil temperature reduces going from the so-called high temperature state to the so-called low temperature state and passing through the threshold temperature, the outer diameter 35 of the buffer reduces, thereby increasing the leakage section 15 of the buffer 13 and the ring 14.

Thus, according to the temperature, the outer diameter of the buffer 13 varies from the high temperature state to the low temperature state (and vice-versa), causing an equivalent variation in the leakage section 15 allowing a counter-recoil rate to be obtained that is substantial constant whatever the temperature and thus whatever the oil viscosity.

The expert will easily define the necessary variation in the leakage section, thus of the outer diameter of the buffer, according to the type of materiel and the type of oil used, so as to obtain a counter-recoil rate that is substantially constant whatever the temperature.

According to a variant embodiment, the heat-sensitive element can be the ring 14, or both the ring 14 and the buffer 13.

The advantage of this embodiment lies in that it is not necessary to have additional parts, the use of a specific, shape-memory, alloy being all that is required.

Figure 3:
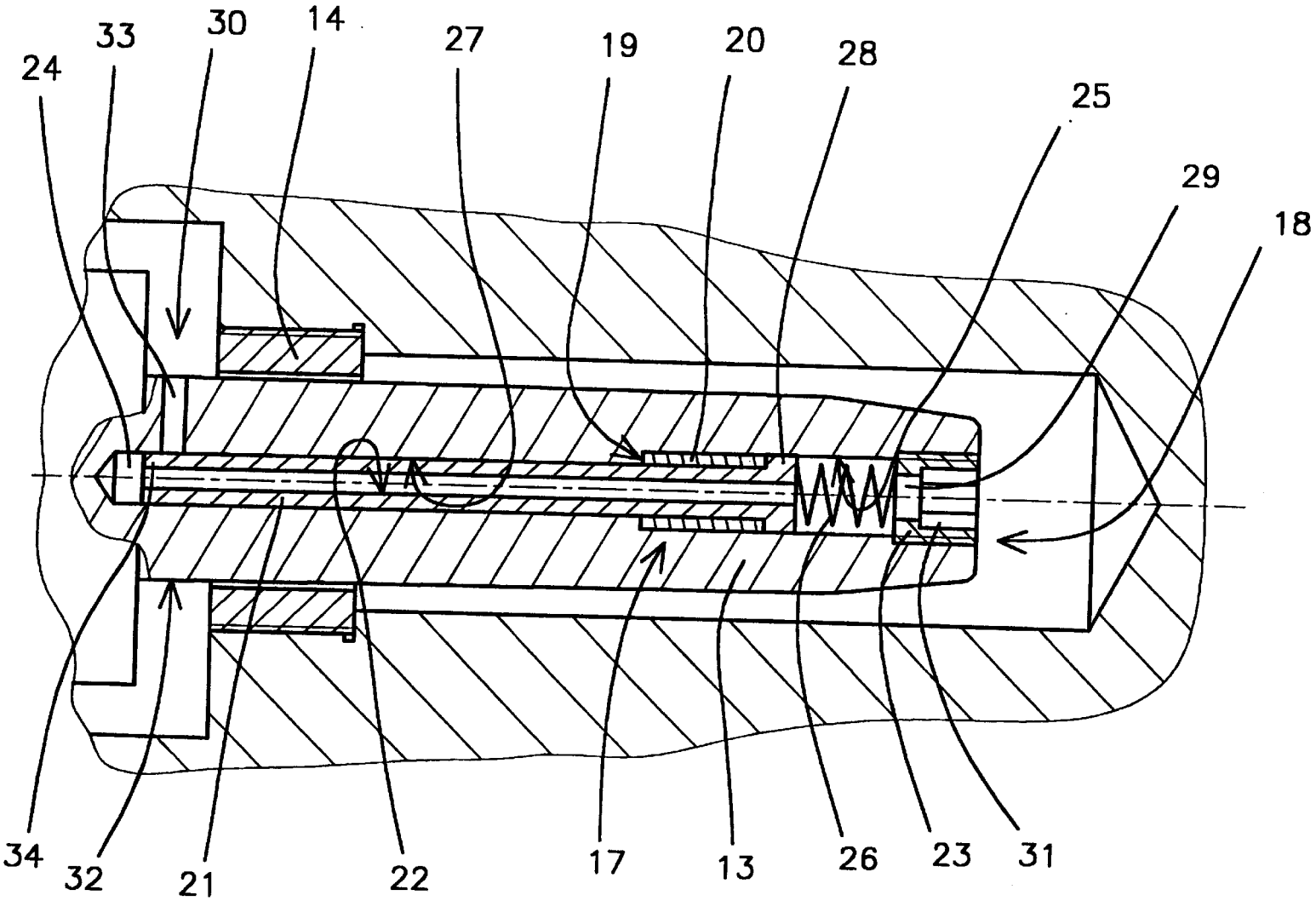
FIG. 3 is a section view of a device to regulate the counter-recoil rate of a cannon, according to a second embodiment, shown at high temperature.
Figure 4:
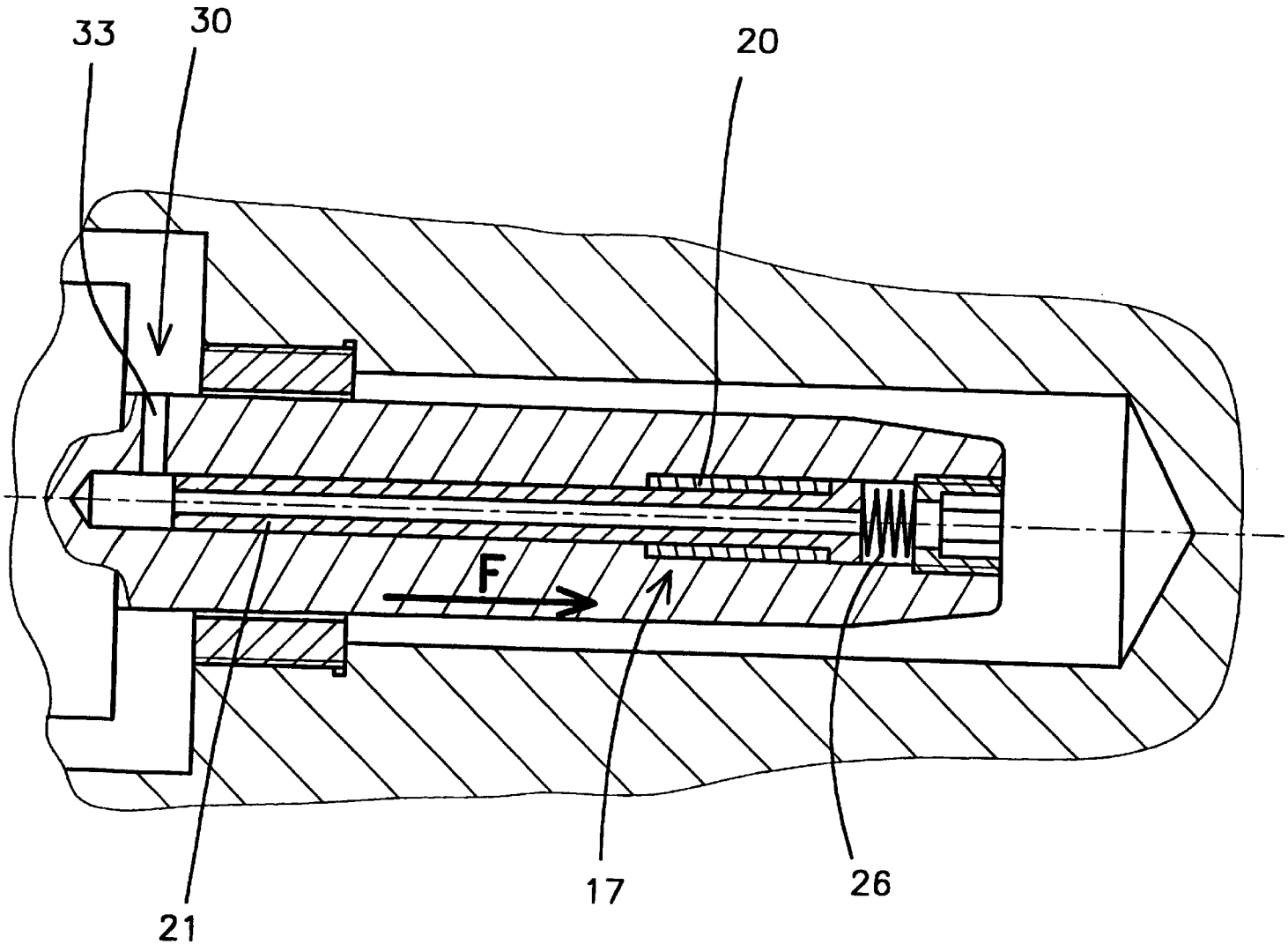
FIG. 4 shows the regulation device in FIG. 3, at low temperature.

FIGS. 3 and 4 show a device to regulate the counter-recoil rate of a cannon according to a second embodiment of the invention.

In this embodiment, the buffer 13 has an additional oil passage 30 whose section is modified by a modulation device 17.

The modulation device 17 is composed of a tube 21 having an inner bore 22, of a tubular heat-sensitive element 20, of a spring 26 and a plug 23. The tube 21 is positioned inside a blind axial channel 24 of the buffer 13. The axial channel 24 has two supports 25 and 27 of different diameters and connected together by a should 19. The tube 21 has a shoulder 28 pressing against the heat-sensitive element 20.The spring 26, pressing against the plug 23, holds the heat-sensitive element 20 in place and holds the shoulder 28 of the tube 21 against the shoulder 19. The plug 23, mounted integral by threading with the front 18 of the buffer, has an axial bore 29 of a greater diameter than the inner bore 22 of the tube 21, as well as an indentation 31, for example of the hexagonal type, intended to ensure its assembly.

The rear part 32 of the buffer incorporates a radial channel 33 that opens into the inside of the axial channel 24.

The additional oil passage 30 is thus provided by the radial channel 33, the axial channel 24, the inner bore 22 of the tube 21, and then the inner bore 29 of the plug 23.

The tubular heat-sensitive element 20 is made of a shape-memory material of the groups of composites such as defined in the previous embodiment. This element has been formed to lengthen or shorten when the temperature threshold is passed.

Thus, FIG. 3 corresponds to the operating situation at high temperature, thus at a low hydraulic viscosity. The heat-sensitive element 20 is consequently in its high temperature state, that is it has a small axial dimension. In this position, the spring 26 has compensated for the axial shortening of the element 20 by pushing one end 34 of the tube 21 in front of the radial channel 33, so as to block it. The oil passage in this case occurs, in a traditional manner, via the leakage section between the buffer 13 and the ring 14.

FIG. 4 represents a situation at low temperature, corresponding to a high oil viscosity. The heat-sensitive element 20 has reacted to the drop in temperature, moving from its high temperature state into its low temperature state as soon as the threshold temperature has been reached, by axially elongating. This elongation has caused the displacement of the tube 21 in a direction F, opening the additional oil passage 30 at the radial channel 33.

The rolling of an oil that has a higher viscosity being more difficult, therefore slower, the passage 30 thus enables in the quantity of oil rolled to be increased and therefore the counter-recoil rate of the recoil mass to be modified, thereby making it substantially constant whatever the temperature.

This embodiment has the advantage of being able to use the definition of buffers known to prior art.

Figure 5:
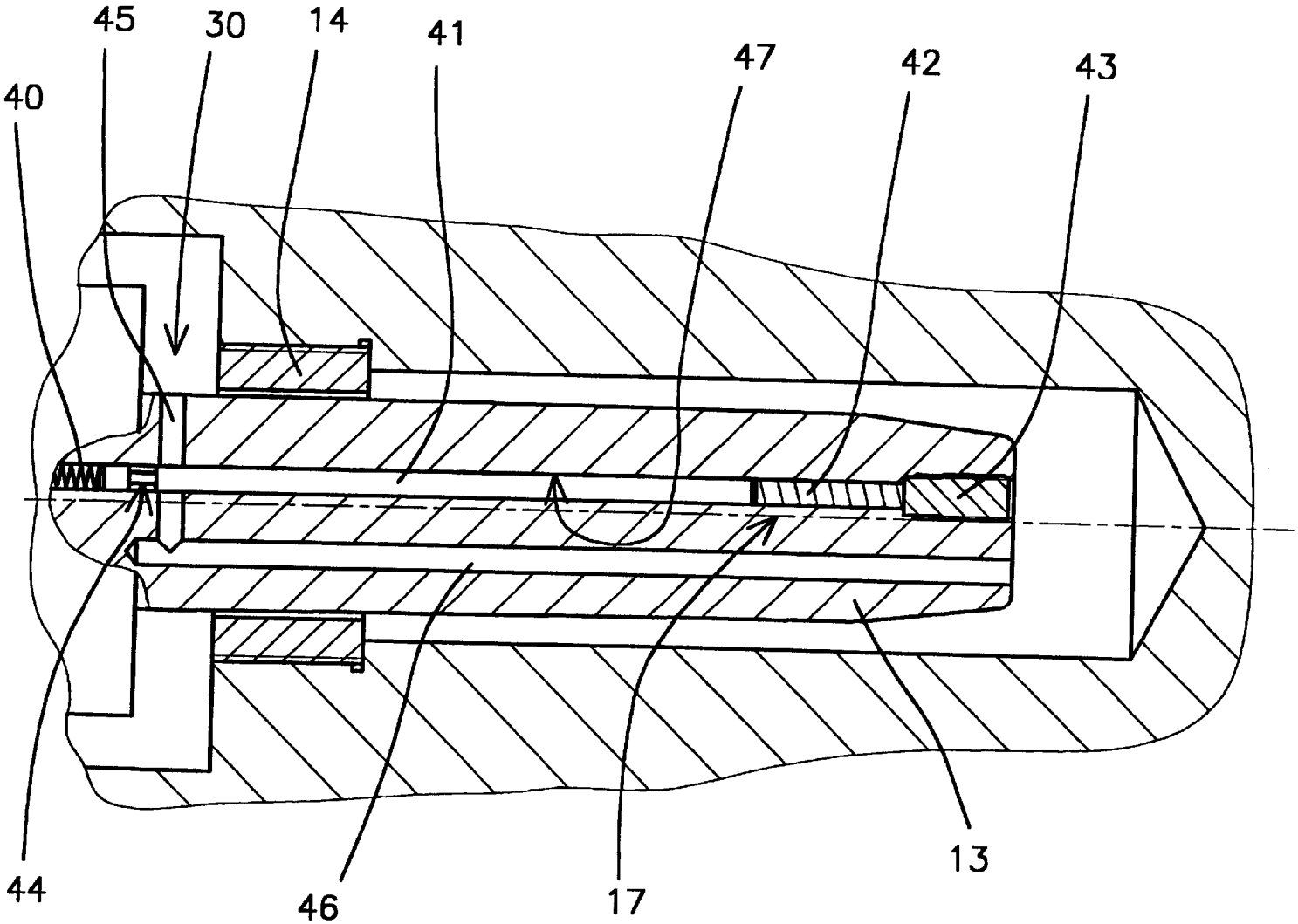
FIG. 5 is a section view of a device to regulate the counter-recoil rate of a cannon, according to a third embodiment, shown at high temperature, FIG. 6 show the regulation device in FIG. 5, at low temperature.
Figure 6:
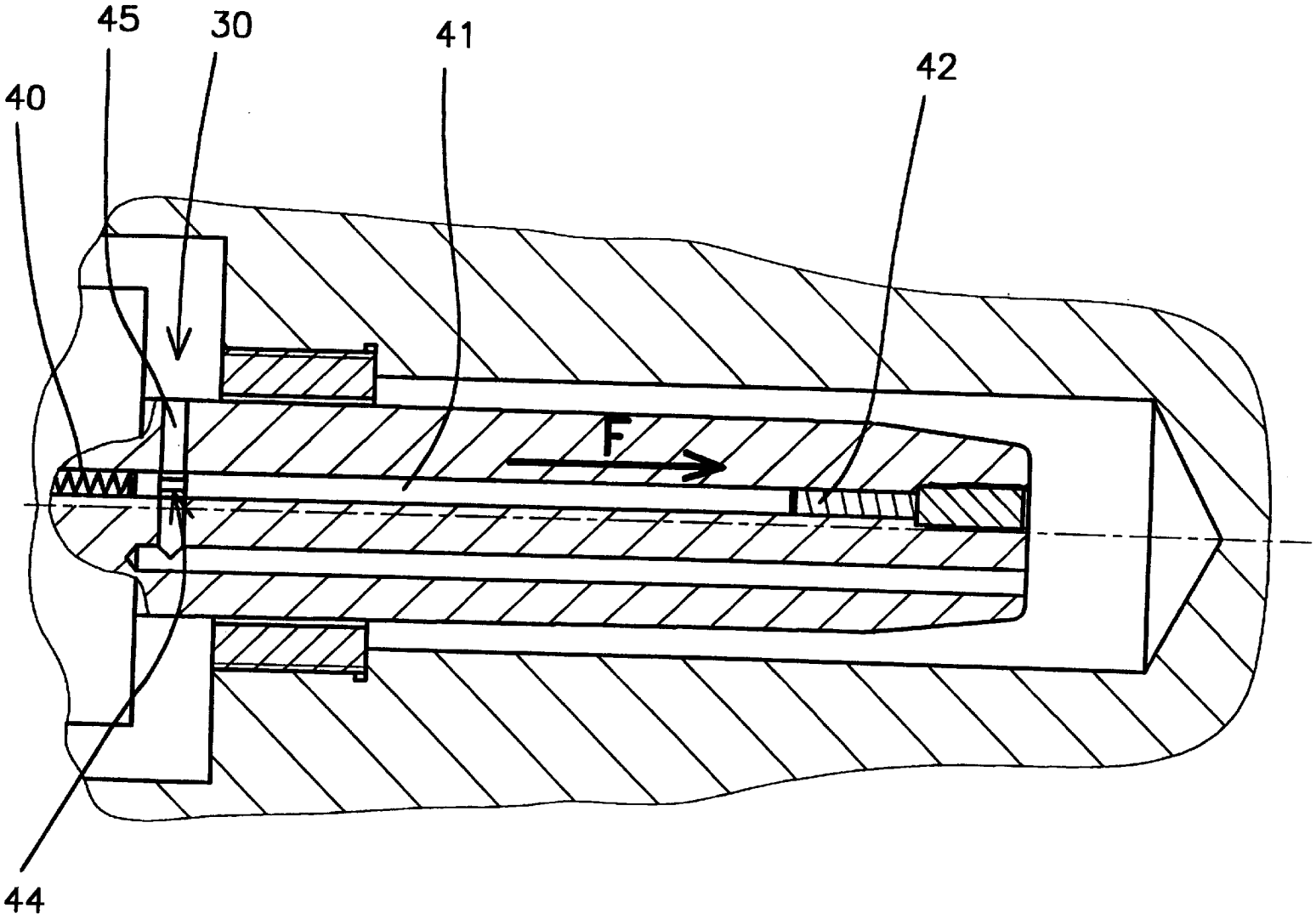

FIGS. 5 and 6 show a third embodiment of a device to regulate the counter-recoil rate of a cannon according to the invention.

In this embodiment, the modulation system 17 is composed of a spring 40, a rod 41, a cylindrical heat-sensitive element 42 and a threaded plug 43. The rod 41 has a groove 44 whose purpose will be explained later.

The additional oil passage 30 is provided by a radial channel 45 and a blind axial channel 46. The radial channel 45 opens into the axial channel 46 and passes through a second axial channel 47 in which the modulation device 17 is positioned.

The heat-sensitive element 42 is made of a shape-memory material of the group of composites such as defined in the first embodiment. This element has been formed so as to lengthen or shorten when the temperature threshold is reached.

FIG. 5 corresponds to the operating situation at high temperature, thus to a low hydraulic viscosity. The heat-sensitive element 42 is consequently in its high temperature state, that is it has a large axial dimension. In this position, the spring 40 is compressed and the radial channel 45 is blocked by the rod 41. The oil passage in this case occurs, in a traditional manner, via the leakage section between the buffer 13 and the ring 14.

FIG. 6 represent a low temperature situation, corresponding to a high oil viscosity, where the heat-sensitive element 42 has reacted to the drop in temperature by shortening axially, moving from its high temperature state into its low temperature state. This compression has caused the displacement of the rod 41 in direction F, under the action of the spring 40, until groove 44 is located at the radial channel 45, opening additional oil passage 30. The oil passage in this case occurs via the combination of the leakage section between the buffer 13 and the ring 14 and the additional passage 30.

The advantage of this embodiment, which is the preferred embodiment, lies in that the heat-sensitive element is not subjected to the pressure of the oil during operation.

Figure 7:
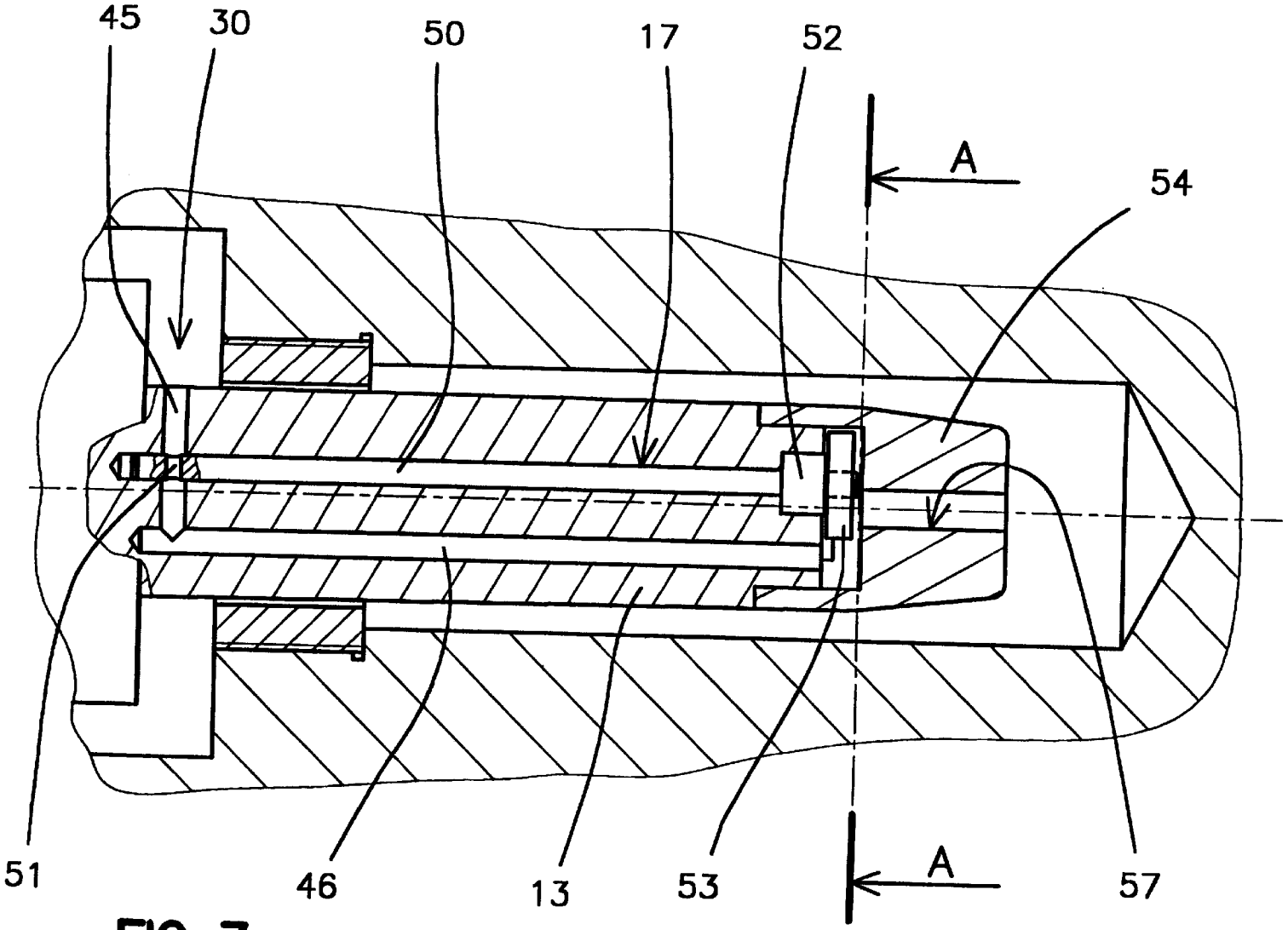
FIG. 7 is a section view of a device to regulate the counter-recoil rate of a cannon, according to a fourth embodiment.

FIG. 7 represents a fourth embodiment of a device to regulate the counter-recoil rate of a cannon according to the invention.

This embodiment differs from the previous one only in the design of the modulation system 17. Said system is composed of a rod 50 and a heat-sensitive element 53. The rod 50 incorporates a radial opening 51 and a shoulder 52.

The front end of the buffer incorporates a cap 54 that holds the rod 50 in place axially. The cap is perforated by a bore 57 intended to enable the passage of the oil.

Figure 8:
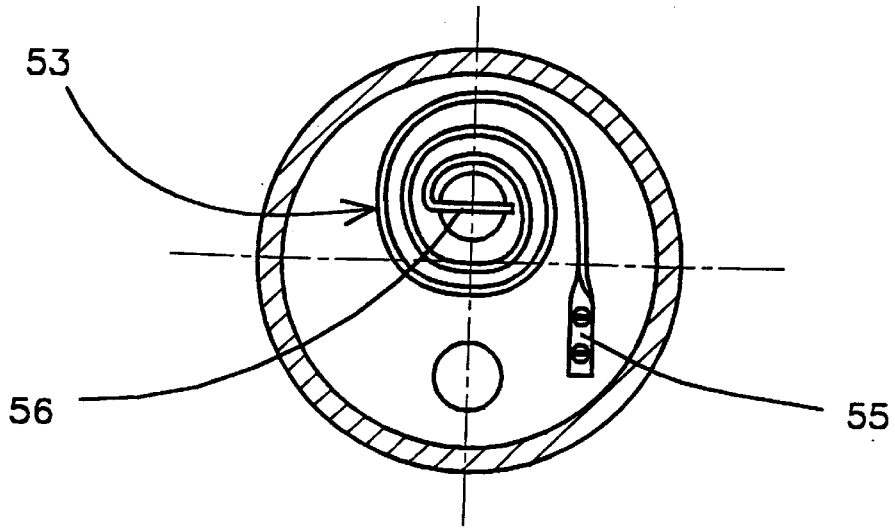
FIG. 8 is a view along A of the front end of the buffer shown in FIG. 7.

FIG. 8 is a view along A of the front end of the buffer 13, without the cap 54.

The heat-sensitive element 53 is constituted by a spiral spring integral firstly with the buffer 13 by one of its ends 55, for example by means of screws, and secondly to the rod 50 by its other end 56, which is, for example, introduced into a slot made in the end of the rod.

The spiral spring 53 is made of a shape-memory material of the group of composites such as defined in the first embodiment. This element has been formed so as to lengthen or shorten when the threshold temperature is reached.

When the temperature drops and after the threshold temperature has been reached, the spiral spring 53 moves from its high temperature state to its low temperature state. It reacts by shortening, thereby causing an angular displacement of the rod 50 that brings the opening 51 into alignment with the radial channel 45 such as to open the additional oil passage 30. The oil passage occurs therefore by the combination of the leakage section between the buffer 13 and the ring 14 and the additional oil passage 30.

On the contrary, when the temperature rises, the spiral spring 53 elongates after the temperature threshold has been reached, thereby causing an angular displacement in the opposite direction of the rod 50 so as to close the radial channel 45.

The oil passage in this case occurs, in a traditional manner, via the leakage section between the buffer 13 and the ring 14.

Figure 9:
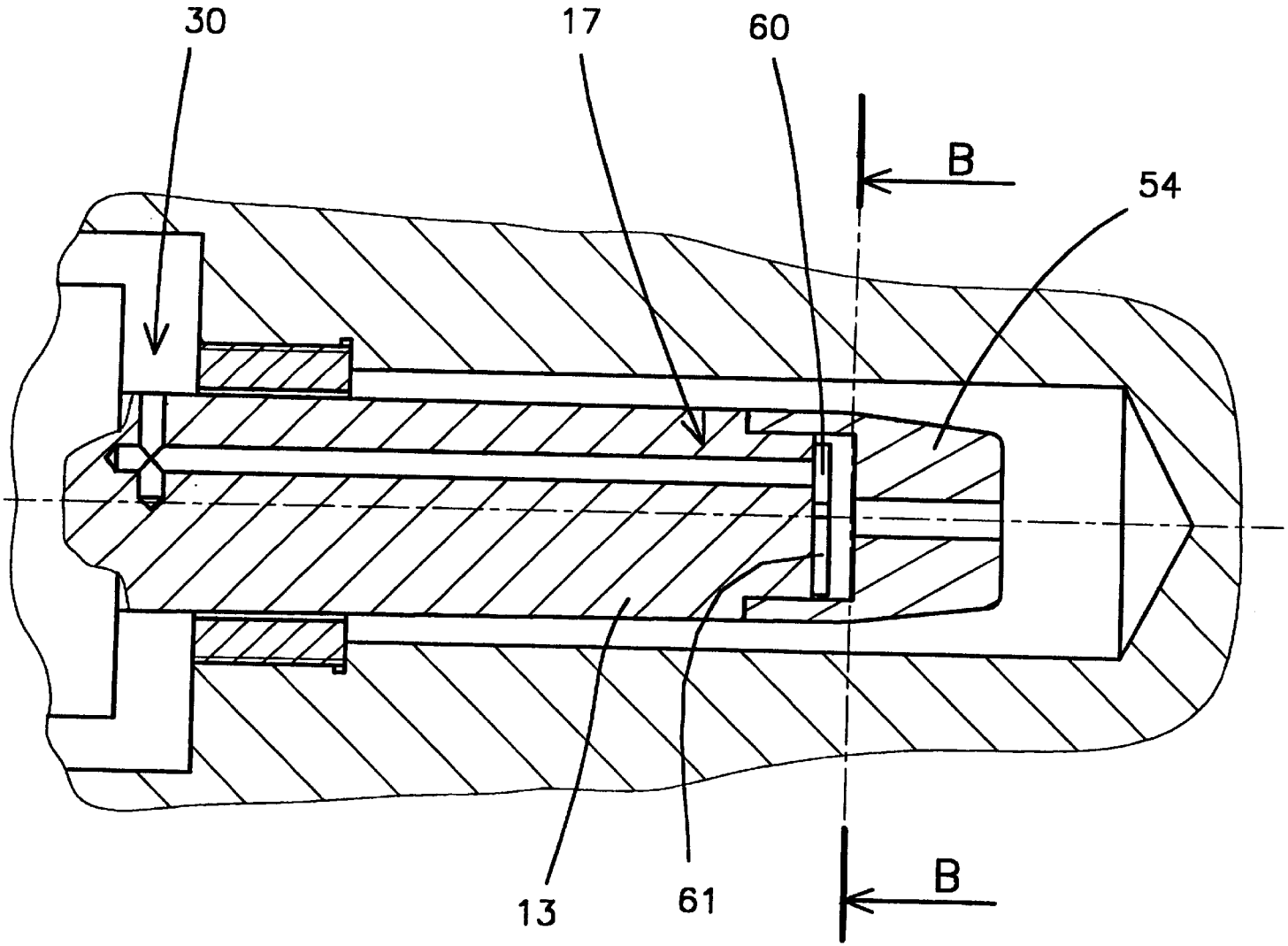
FIG. 9 is a section view of a device to regulate the counter-recoil rate of a cannon, according to a fifth embodiment.

FIG. 9 shows a fifth embodiment of a device to regulate the counter-recoil rate of a cannon according to the invention.

This embodiment only differs from the previous one in the design of the modulation system 17. Said system is composed of a flap 60 integral with a heat-sensitive element 61 in the shape of a bent blade. Said blade is integral with the buffer 13, for example by means of screws.

The front end of the buffer also incorporates a cap 54.

The heat-sensitive blade 61 is made of a shape-memory material of the group of composites such as defined in the first embodiment. This element has been formed to open or close when the threshold temperature has been reached.

Figure 10:
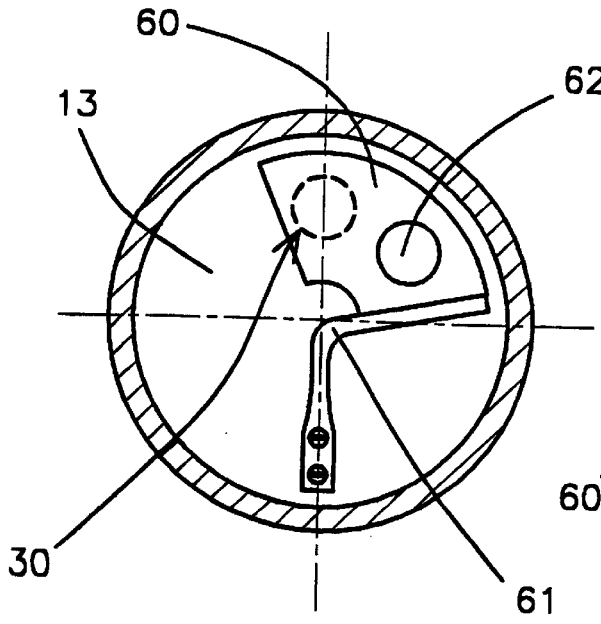
FIG. 10 is a view along B of the front end of the buffer shown in FIG. 9, shown at high temperature.

FIG. 10 represents the front end of the buffer 13 along B, without cap 54.

It represents a high temperature situation, corresponding to a low oil viscosity, where the heat-sensitive blade 61 is in its high temperature state. The flap 60 incorporates an opening 62 that is in an offset position with respect to the passage 30. Said passage being closed, the oil passage in this case occurs, in a traditional manner, via the leakage section between the buffer 13 and the ring 14.

Figure 11:
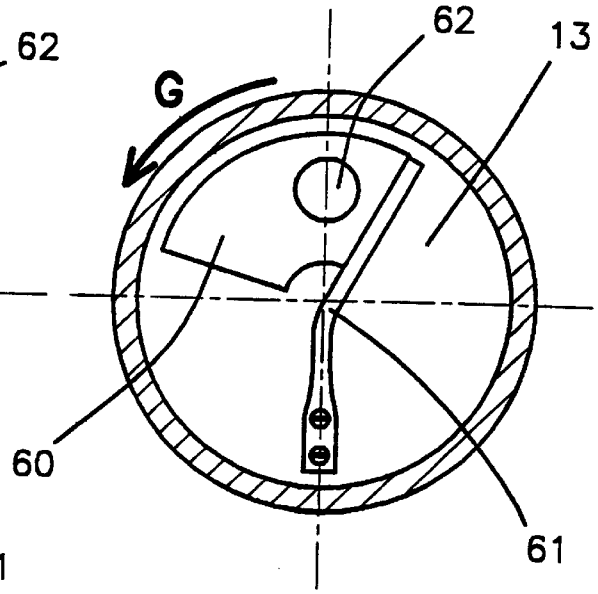
FIG. 11 is a view along B of the front end of the buffer shown in FIG. 9, shown at low temperature.

FIG. 11 represents a low temperature situation, corresponding to a high oil viscosity, where the heat-sensitive blade 61 has reacted to the drop in temperature by unfolding, moving from its high temperature state to its low temperature state, thereby causing the angular displacement of the flap 60 in a direction G such as to bring the opening 62 opposite the passage 30. The leakage section is thus increased by the passage 30.

Naturally, these braking devices for the recoil mass at the end of the counter-recoil operation can be integrated into another type of recoil brake. In particular, they can be mounted onto a recoil brake fitted with a sheath or jacket incorporating a profiled opening instead of a counter-rod system.

What is claimed is:

1. A device to regulate the counter-recoil rate for an artillery cannon according to the temperature, comprising a buffer co-operating with a ring, so as to ensure the gradual braking of said cannon at the end of the counter-recoil operation by rolling a brake oil through a leakage section located between said buffer and said ring, said device incorporates at least one modulation device comprising a heat-sensitive element made in a shape-memory alloy, said element ensuring, by its distortion, an increase in said leakage section when the temperature drops below a given threshold.

2. A device according to claim 1, wherein said heat-sensitive element is constituted by the ring.

3. A device according to claim 1, wherein said heat-sensitive element is integral with said buffer.

4. A device according to claim 3, wherein said heat-sensitive element is constituted by said buffer.

5. A device according to claim 3, wherein said buffer incorporates an additional oil passage whose section is modified by said modulation device displaced by the action of said heat-sensitive device.

6. A device according to claim 5, wherein said additional oil passage is constituted by at least one blind axial channel opening out to the fore of said buffer and by a blind radial channel made somewhere to the rear of said buffer, said two channels being inter-connected.

7. A device according to claim 6, wherein said modulation device comprises a tube placed inside said axial channel of said buffer, said tube being able to block said radial channel under the action of said heat-sensitive element when the temperature has reached the given threshold, said tube being displaced axially in one direction by the action of said heat-sensitive element and in the other by the action of a first spring.

8. A device according to claim 6, wherein said buffer incorporates a second blind axial channel opening out at the end of said radial channel so as to provide said additional oil passage and wherein said modulation device comprises an axial rod placed inside said first axial channel, said rod being able to block said radial channel under the action of said heat-sensitive element when the temperature exceeds said given threshold.

9. A device according to claim 8, wherein said rod incorporates a groove for the passage of the oil and is displaced axially in one direction by the action of said heat-sensitive element and in the other by the action of a second spring so as to bring said groove opposite said radial channel of said buffer.

10. A device according to claim 8, wherein said rod incorporates a radial opening for the passage of the oil located at said radial channel of said buffer and it can be displaced angularly by said heat-sensitive element.

11. A device according to claim 6, wherein said modulation device comprises a flap able to block the front end of said axial channel of said buffer, such flap being displaced angularly by said heat-sensitive element.

* * * * *